US006344633B1

(12) United States Patent
Furuuchi

(10) Patent No.: US 6,344,633 B1
(45) Date of Patent: Feb. 5, 2002

(54) STACKED PROTECTIVE DEVICE LACKING AN INSULATING LAYER BETWEEN THE HEATING ELEMENT AND THE LOW-MELTING ELEMENT

(75) Inventor: Yuji Furuuchi, Kanuma (JP)

(73) Assignee: Sony Chemicals Corp., Tokyo (JP)

( * ) Notice: Subject to any disclaimer, the term of this patent is extended or adjusted under 35 U.S.C. 154(b) by 0 days.

(21) Appl. No.: 09/520,184

(22) Filed: Mar. 7, 2000

(30) Foreign Application Priority Data

Mar. 31, 1999 (JP) ..... 11-094385

(51) Int. Cl.[7] ..... H05B 1/02
(52) U.S. Cl. ..... 219/517; 219/481; 219/548
(58) Field of Search ..... 219/481, 505, 219/517, 504, 497, 491, 548, 494, 543, 553, 253; 338/22 R, 225 C

(56) References Cited

U.S. PATENT DOCUMENTS 4,034,207 A * 7/1977 Tamada ..... 219/517
4,501,956 A * 2/1985 Bergensen et al. ..... 219/553
5,173,593 A * 12/1992 Ogino et al. ..... 219/264

FOREIGN PATENT DOCUMENTS

| | | |
|---|---|---|
| JP | A 8-161990 | 6/1996 |
| JP | A 10-116549 | 5/1998 |
| JP | A 10-116550 | 5/1998 |
| JP | B2 2790433 | 6/1998 |

* cited by examiner

*Primary Examiner*—Mark Paschall
(74) *Attorney, Agent, or Firm*—Oliff & Berridge, PLC

(57) ABSTRACT

A protective device includes a heating element and a low-melting metal element on a substrate, the low-melting metal element being fused by the heat generated by the heating element, and in this device the heating element and the low-melting metal element are stacked so as not to allow an insulating layer to intervene therebetween, and as a result the protective device is miniaturized and the operating time reduced without lowering the rated current.

5 Claims, 6 Drawing Sheets

( x — x Cross Section)

( x — x Cross Section)

( x — x Cross Section)

( x — x Cross Section)

(x − x Cross Section)

(x − x Cross Section)

STACKED PROTECTIVE DEVICE LACKING AN INSULATING LAYER BETWEEN THE HEATING ELEMENT AND THE LOW-MELTING ELEMENT

BACKGROUND OF THE INVENTION

1. Field of the Invention

The present invention relates to a protective device in which a heating element is energized during a malfunction, whereby the heating element is heated and a low-melting metal element is fused.

2. Related Art of the Invention

The conventional current fuses in which low-melting metal element composed of lead, tin, antimony, or the like are fused by overcurrent are widely known as protective devices for cutting off such overcurrent. Protective devices comprising heating elements and low-melting metal elements are also known as protective devices capable of preventing not only overcurrents but also overvoltages (Japanese Patent No. 2,790,433; Japanese Patent Application Laid-Open No. 8-161990, etc.).

FIG. 9 is a circuit diagram of an overvoltage prevention device featuring such a protective device 1*p*. FIG. 10A and FIG. 10B are respectively a plane view and a cross sectional view of the protective device 1*p*. The protective device 1*p* is obtained by the sequential stacking of the following elements on a substrate 2: a heating element 3 (formed by applying or otherwise spreading a resistance paste), an insulating layer 4, and a low-melting metal element 5 composed of a fuse material. In the drawing, the numerals 6*a* and 6*b* are electrodes for the heating element, and the numerals 7*a* and 7*b* are electrodes for the low-melting metal element. In addition, the numeral 8 is an inside seal composed of solid flux or the like and designed to seal the low-melting metal element 5 in order to prevent the surface of this low-melting metal element 5 from being oxidized; and the numeral 9 is an outside seal composed of a material whose melting point or softening point is higher than that of the low-melting metal element 5 and designed not to allow molten material to flow outside the device during the fusion of the low-melting metal element 5.

In the overvoltage prevention device shown in FIG. 9 and obtained using the protective device 1*p*, the electrode terminals of, for example, a lithium ion battery or other device to be protected are connected to terminals A1 and A2; and the electrode terminals of, for example, a charger or other device connected to the device to be protected are connected to terminals B1 and B2. With this overvoltage prevention device, when the lithium ion battery is charged and a reverse voltage higher than the breakdown voltage is applied to a Zener diode D, base current ib flows in an abrupt manner, substantial collector current ic greater than the base current ib is caused to flow across the heating element 3, and the heating element 3 is heated. This heat is transmitted to the low-melting metal element 5 on the heating element 3, the low-melting metal element 5 is fused, and the application of overvoltage to the terminals A1 and A2 is prevented.

With the overvoltage prevention device in FIG. 9, however, current continues to flow through the heating element 3 even after the low-melting metal element 5 has been fused by the overvoltage. An overvoltage prevention device whose circuitry is shown in FIG. 11 is also known. FIG. 12A and FIG. 12B are respectively a plane view and a cross sectional view of the protective device 1*q* used in this overvoltage prevention device. In this protective device 1*q*, two heating elements 3 are connected by means of an intermediate electrode 6*c*, and a low-melting metal element 5 is disposed thereon so as to allow an insulating layer 4 to intervene therebetween.

In the overvoltage prevention device shown in FIG. 11, the heat generated by the heating elements 3 fuses the low-melting metal element 5 at two locations (5*a* and 5*b*), completely cutting off electric power to the heating elements 3 following this type of fusion.

Also known is a protective device 1*r* in which the arrangement in which a heating element 3 and low-melting metal element 5 are stacked so as not to allow an insulating layer 4 to intervene therebetween, is replaced by an arrangement in which a heating element 3 and a low-melting metal element 5 are arranged in a planar configuration on a substrate 2, as shown in FIG. 13. In the drawing, the numerals 6*d*, 6*e*, 6*f*, and 6*g* are electrodes, and the numeral 8 is an inside seal consisting of a flux coating film (Japanese Patent Application Laid-open Nos. 10-116549 and 10-116550).

In situations such as those encountered with the protective device 1*p* or 1*q* shown in FIGS. 10A and 10B or FIGS. 12A and 12B, stacking the heating element 3 and the low-melting metal element 5 so as to allow the insulating layer 4 to intervene therebetween makes it difficult to reduce the operating time (that is, the time from the energizing of the heating element 3 to the fusing of the low-melting metal element 5) because the heat-up of the low-melting metal element 5 is slowed down by the delay in heat transfer due to the presence of the insulating layer 4 during the heating of the heating element 3. When glass components are used for the insulating layer 4, the insulating layer 4 flows during heating, creating a risk that fusion characteristics will be adversely affected.

In a structure in which a heating element 3 and a low-melting metal element 5 are arranged in a planar configuration on a substrate 2 (as in the protective device 1*r* in FIG. 13), the planar configuration of the elements cannot be miniaturized because separate planar spaces are required for arranging the heating element 3 and the low-melting metal element 5. Consequently, the protective device 1*r* is larger than the above-described protective device 1*p* or 1*q*, which are obtained by stacking the heating element 3 and the low-melting metal element 5 so as to allow the insulating layer 4 to intervene therebetween.

Merely reducing the size of the protective device 1*r* in this case will result in a smaller surface area for the electrodes, making it impossible to fuse the low-melting metal element 5 because of low rated current or insufficient heat generation.

Another feature of the protective device 1*r* is that the heat from the heating element 3 during heating is transferred via the electrode 6*g* and the substrate 2, slowing down the heat-up of the low-melting metal element 5 and hence increasing the operating time. Mounting the protective device 1*r* on the base circuit substrate with the aid of solder in order in an attempt to enhance the thermal conductivity of the substrate 2 (and thus to eliminate the delay in the operating time) is disadvantageous because the mounting solder melts before the fusion of the low-melting metal element 5, and the protective device 1*r* separates from the base circuit substrate. In addition, lowering the melting point of the low-melting metal element 5 in order to eliminate the delay in the operating time has an adverse effect on the reflow resistance of the protective device 1*r* during mounting, makes it impossible to use automatic mounting, and turns the protective device 1*r* into a hand-mounted component.

SUMMARY OF THE INVENTION

An object of the present invention is to overcome the shortcomings of prior art and to make it possible to miniaturize the devices and to reduce the operating time without reducing the rated current in a protective device in which a low-melting metal element is fused by the energizing of a heating element.

The inventor perfected the present invention upon discovering that to cause fusion in a protective device in which a heating element and a low-melting metal element are formed on a substrate, and the low-melting metal element is fused by the heat generated by the heating element, it is important that adequate space be provided for the low-melting metal element to wet the surface and to spread thereover during melting, resulting in fusion; that the fusion of the low-melting metal element can be facilitated by making it easier for the molten low-melting metal element to wet the heating element, electrodes, and other components in contact with the low-melting metal element; that the section wetted by the fused low-melting metal element or the area in the vicinity of this section may in this case serve as the location in which the material is heated by this heating element; and that there is, therefore, no need to stack the low-melting metal element on the heating element so as to allow the insulating layer to intervene therebetween and to cause the entire heating element to generate heat in the same manner as in the conventional protective device 1*p* or 1*q* in FIGS. 10A and 10B or FIGS. 12A and 12B.

Specifically, the present invention provides a protective device comprising a heating element and a low-melting metal element on a substrate, the low-melting metal element being fused by heat generated by the heating element, wherein the heating element and the low-melting metal element are stacked so as not to allow an insulating layer to intervene therebetween.

Because the heating element and the low-melting metal element in the protective device of the present invention are stacked so as not to allow an insulating layer to intervene therebetween, the temperature of the low-melting metal element can increase rapidly during the heating of the heating element, and the operating time can be reduced. In addition, there is no risk that the insulating layer will have an adverse effect on the fusion characteristics of the low-melting metal element, as in the conventional protective devices.

It is also possible to miniaturize the protective device without reducing the rated current of the protective device, compared with the conventional protective devices, because of an increase in the proportion of the surface area or volume of the low-melting metal element in the protective device.

This and other objects, features and advantages of the present invention are described in or will become apparent from the following detailed description of the invention.

DETAILED DESCRIPTION OF THE INVENTION

Figure 1A:
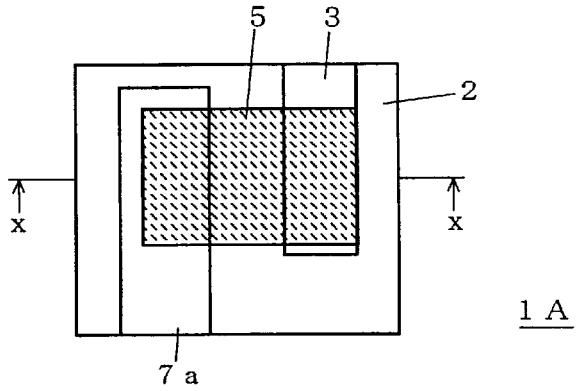
FIG. 1A and FIG. 1B are respectively a plane view and a cross sectional view of a protective device pertaining to the present invention.

The present invention will now be described in detail with reference to drawings. In the drawings, the same symbols refer to identical or equivalent structural elements.

Figure 1B:
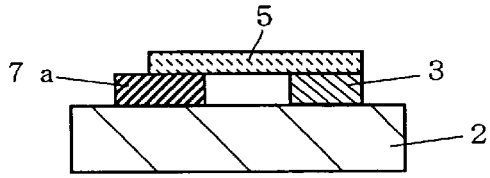
Figure 1C:
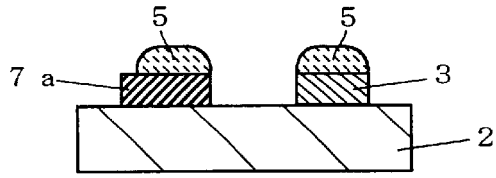
FIG. 1C is a cross sectional view of a low-melting metal element during fusion.
Figure 9:
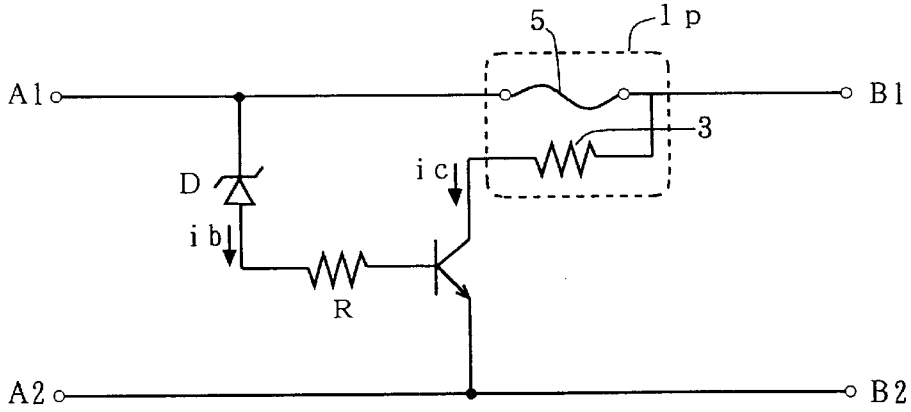
FIG. 9 is a circuit diagram of an overvoltage prevention device.

FIG. 1A and FIG. 1B are respectively a plane view and a cross sectional view of the protective device 1A of the present invention, which can be obtained using the same circuit as that of the protective device 1*p* in the overvoltage prevention device shown in FIG. 9. FIG. 1C is a cross sectional view of a low-melting metal element in the fused state.

In this protective device 1A, a heating element 3 and a low-melting metal element electrode 7*a* are formed on a substrate 2, and a low-melting metal element 5 is formed directly on these low-melting metal element electrode 7*a* and heating element 3. Although not shown in the drawing, the low-melting metal element 5 may be covered with an inside seal composed of solid flux or the like and aimed at preventing the surface of the element from being oxidized, and the outside of the element may be covered with an outside seal or a cap in order to prevent the molten material from flowing outside the device during the fusing of the low-melting metal element 5.

No particular restrictions are imposed on the substrate 2 in this case. A plastic film, glass epoxy substrate, ceramic substrate, metal substrate, or the like may be used. An inorganic substrate is preferred for such use.

The heating element 3 may, for example, be formed by applying a resistance paste comprising an electroconductive material (ruthenium oxide, carbon black, or the like) and an inorganic binder (water glass or the like) or an organic binder (thermosetting resin or the like), and optionally followed by baking. The heating element 3 may also be formed by printing, plating, vapor-depositing, or sputtering a thin film of ruthenium oxide, carbon black, or the like. The element may further be formed by bonding, stacking, or otherwise processing such films.

The low-melting metal element 5 may preferably have a large surface area to facilitate melting by heat during the heat-up of the heating element 3, to allow the heating element 3 or the low-melting metal element electrode 7*a* to be adequately wetted, and to achieve accelerated fusion. The rated current can be increased in proportion to the surface area.

The various low-melting metal elements used as the conventional fuse materials can also be employed as the material for forming the low-melting metal element 5. It is, for example, possible to use the alloys listed in Table 1 of Paragraph 0019 of Japanese Patent Application Laid-open No. 8-161990.

A single metal (copper or the like) electrode or an electrode plated on the surface with Ag—Pt, Au, or the like may be used as the low-melting metal element electrode 7*a*. To accelerate the fusion of the low-melting metal element 5 during the heating of the heating element 3 a metal having improved wettability during the heat melting of the low-melting metal element 5 may preferably be used at least on the side of the low-melting metal element electrode 7*a* facing the low-melting metal element 5. Examples of such metals include Ag—Pt, Au, and Ag—Pd.

Figure 10A:
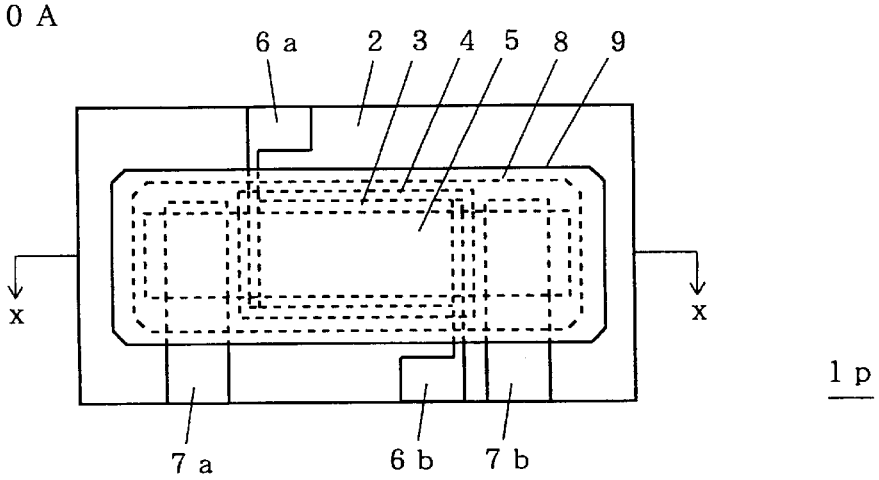
FIG. 10A and FIG. 10B are respectively a plane view and a cross sectional view of a conventional protective device.
Figure 10B:
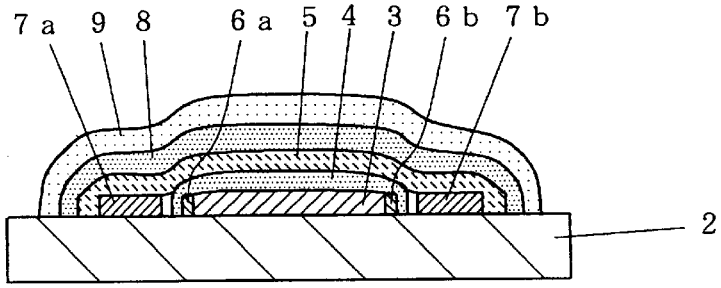

When the overvoltage prevention device shown in FIG. 9 is constructed using the protective device 1A, the heating element 3 generates heat during the passage of large collector current ic in the same manner as when the conventional protective device 1*p* shown in FIGS. 10A and 10B is used, but this heat can be transmitted directly to the low-melting metal element 5 on the heating element 3 so as not to allow the insulating layer to intervene therebetween, allowing the low-melting metal element 5 to be rapidly fused, as shown in FIG. 1C.

Figure 2A:
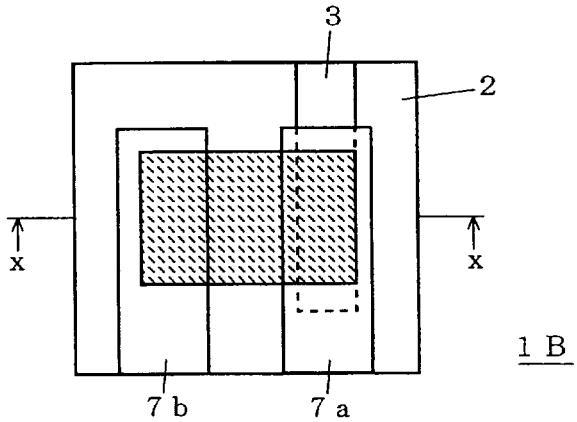
FIG. 2A and FIG. 2B are respectively a plane view and a cross sectional view of a protective device pertaining to the present invention.
Figure 2B:
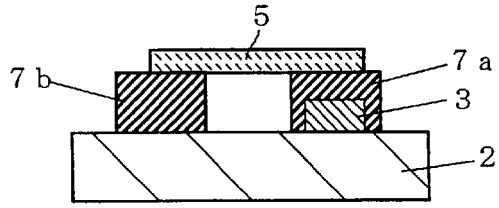

FIG. 2A and FIG. 2B are respectively a plane view and a cross sectional view of a protective device 1B that can be used for the overvoltage prevention device in FIG. 9 in the same manner as for the protective device 1A in FIGS. 1A to 1C. This protective device 1B is provided with a first low-melting metal element electrode 7*a* in a manner such that the heating element 3 on the substrate 2 is partially covered, and a low-melting metal element 5 is formed in a manner such that a bridge is formed between the first low-melting metal element electrode 7*a* and a second low-melting metal element electrode 7*b* separately formed on the substrate 2. In the protective device 1B, the low-melting metal element 5 can be fused even faster during the heating of the heating element 3 if the low-melting metal element electrodes 7*a* and 7*b* formed at the two ends of the low-melting metal element 5 are both constructed from a metal that provides good wettability during the heat melting of the low-melting metal element 5.

Figure 3A:
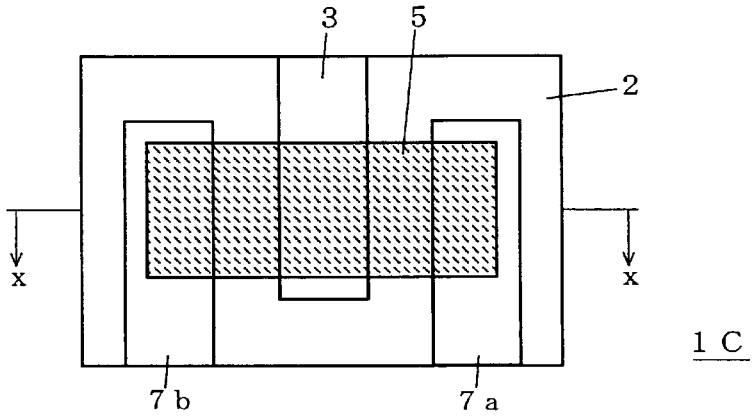
FIG. 3A and FIG. 3B are respectively a plane view and a cross sectional view of a protective device pertaining to the present invention.
Figure 3B:
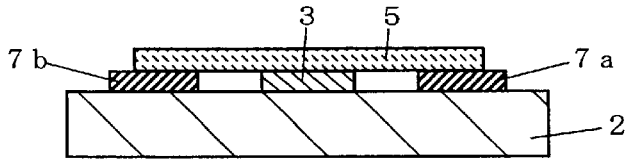
Figure 11:
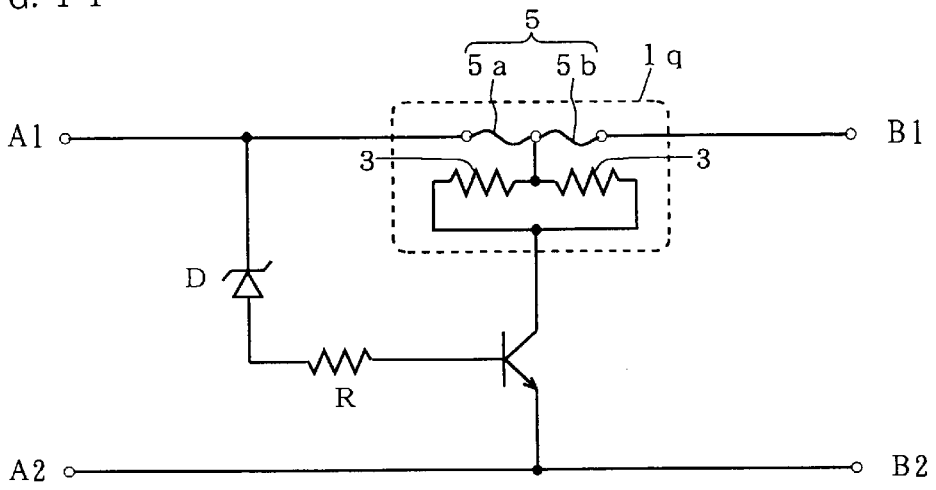
FIG. 11 is a circuit diagram of an overvoltage prevention device.

FIG. 3A and FIG. 3B are respectively a plane view and a cross sectional view of a protective device 1C pertaining to the present invention, which can be obtained using the same circuit as that of the protective device 1*q* in the overvoltage prevention device shown in FIG. 11.

In the protective device 1C, low-melting metal element electrodes 7*a* and 7*b* are formed at both ends of the low-melting metal element 5, and a heating element 3 is formed between these electrodes 7*a* and 7*b* at positions that exclude contact with electrodes 7*a* and 7*b*. Consequently, the low-melting metal element 5 fuses at two locations (between the heating element 3 and the electrode 7*a*, and between the heating element 3 and the electrode 7*b*) during the heating of the heating element 3.

Figure 4:
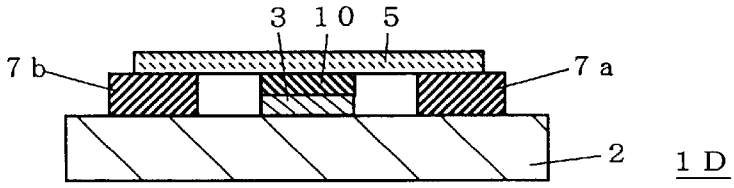
FIG. 4 is a cross sectional view of a protective device pertaining to the present invention.

The protective device 1D in FIG. 4 is obtained by modifying the protective device 1C in FIGS. 3A and 3B in a manner such that a metal layer 10 having improved wettability in relation to the low-melting metal element 5 during heat melting is formed on the heating element 3, and the low-melting metal element 5 is stacked on top thereof to accelerate the fusion of the low-melting metal element 5 during the heating of the heating element 3. Similar to the structural materials for the low-melting metal element electrode 7*a* of the protective device 1A described above with reference to FIGS. 1A to 1C, Ag—Pt, Au, and Ag—Pd may be cited as examples of such metals.

Figure 5:
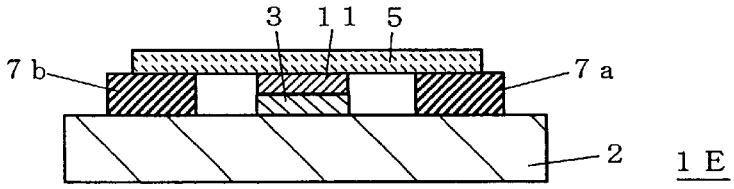
FIG. 5 is a cross sectional view of a protective device pertaining to the present invention.
Figure 6:
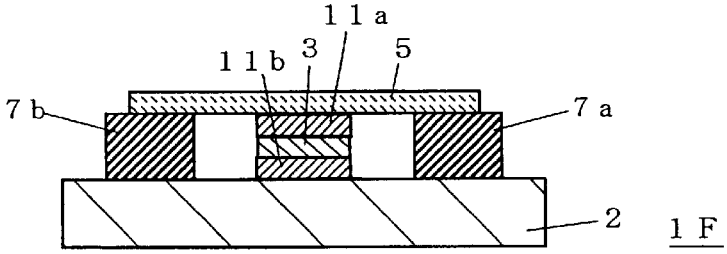
FIG. 6 is a cross sectional view of a protective device pertaining to the present invention.

The protective device 1E in FIG. 5 is obtained by modifying the protective device 1C in FIGS. 3A and 3B in a manner such that a good conductor layer 11 whose electrical conductivity is higher than that of the heating element 3 is formed on the heating element 3 to allow the low-melting metal element 5 on the heating element 3 to be uniformly heated during the heating of the heating element 3. The protective device 1F in FIG. 6 is obtained by forming a first good conductor layer 11*a* on the upper surface of the heating element 3, and a second good conductor layer 11*b* on the lower surface of the heating element 3 to achieve even better uniformity in heating the low-melting metal element 5. Such good conductor layers 11*a* and 11*b* can be formed from Ag—Pt, Ag—Pd, Au, or the like.

Figure 7:
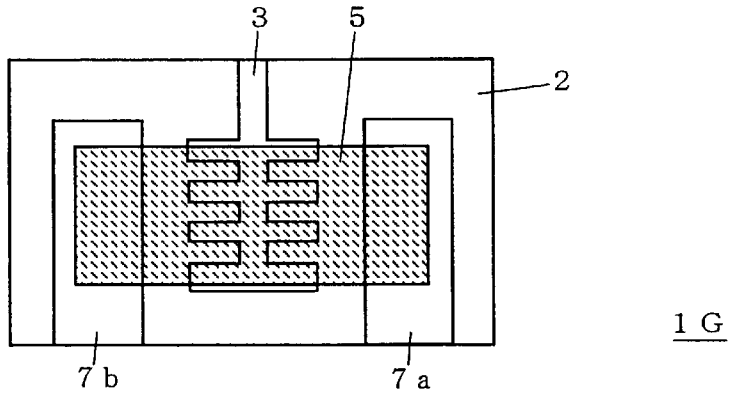
FIG. 7 is a plane view of a protective device pertaining to the present invention.

The protective device 1G in FIG. 7 is obtained by shaping the heating element 3 in a pectinated configuration to allow the low-melting metal element 5 on the heating element 3 to be uniformly heated.

Figure 8A:
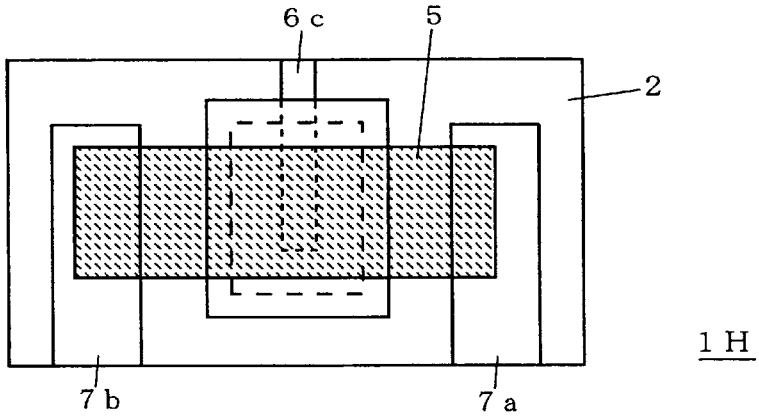
FIG. 8A and FIG. 8B are respectively a plane view and a cross sectional view of a protective device pertaining to the present invention.
Figure 8B:
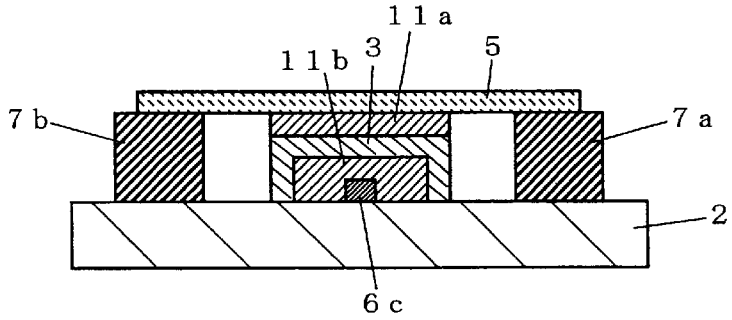
Figure 8C:
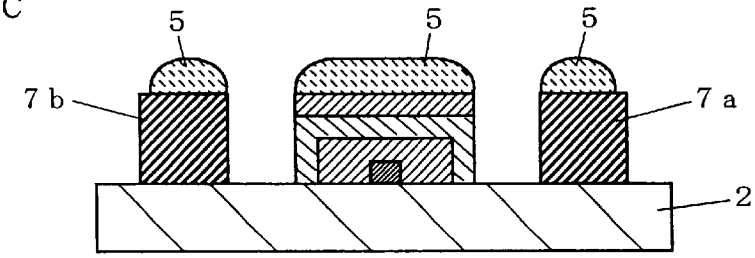
FIG. 8C is a cross sectional view of a low-melting metal element during fusion.

FIG. 8A and FIG. 8B are respectively a plane view and a cross sectional view of another protective device 1H pertaining to the present invention. FIG. 8C is a cross sectional view of a low-melting metal element in the fused state. In the protective device 1H, as in the protective device 1F shown in FIG. 6, good conductor layers 11*a* and 11*b* are provided to both the upper and the lower surfaces of a heating element 3 in a manner such that the good conductor layer 11*b* on the lower surface of the heating element 3 is covered by the heating element 3 to prevent the good conductor layers 11*a* and 11*b* on the upper and lower surface of the heating element 3 from being shorted, and an intermediate electrode 6*c* is brought out from inside the second good conductor layer 11*b* to achieve uniform heating. The resistance value of the intermediate electrode 6*c* may preferably be lower than that of the heating element 3 but higher than that of the good conductor layers 11*a* and 11*b*. In more-specific terms, the volume resistance thereof must be at least one order of magnitude greater than that of the low-melting metal element electrodes 7*a* and 7*b* or the good conductor layers 11*a* and 11*b*.

In addition to the embodiments described above, various other embodiments may be adopted for the protective device of the present invention as long as the heating element and the low-melting metal element are stacked on the substrate so as not to allow an insulating layer to intervene therebetween.

EXAMPLES

The present invention will now be described in detail through working examples.

Working Example 1

The protective device 1H in FIGS. 8A to 8C was fabricated in the following manner. An alumina ceramic substrate (thickness: 0.5 mm; dimensions: 5 mm×3 mm) was, prepared as a substrate 2, and an Ag—Pd paste (6177T, manufactured by Du Pont) was first printed (thickness: 10 μm; dimensions: 0.4 mm×2.0 mm) and baked for 30 minutes at 850° C. in order to form an intermediate electrode 6*c* thereon. An Ag—Pt paste (5164N, manufactured by Du Pont) was subsequently printed (thickness: 10 μm; dimensions: 1.5 mm×1.8 mm) and baked for 30 minutes at 850° C. in order to form a good conductor layer 11*b*. A ruthenium oxide-based resistance paste (DP1900, manufactured by Du Pont) was subsequently printed (thickness: 50 μm) and baked for 30 minutes at 850° C. (such that the good conductor layer 11*b* was covered) in order to form a heating element 3. The pattern resistance value of the resulting heating element 3 was 1 Ω. The Ag—Pt paste (5164N, manufactured by Du Pont) was then printed (thickness: 10 μm) and baked for 30 minutes at 850° C. in order to form a good conductor layer 11*a* on the heating element 3.

In addition, the Ag—Pt paste (5164N, manufactured by Du Pont) was printed (thickness: 10 μm; dimensions: 1.0 mm×3.0 mm) and baked for 30 minutes at 850° C. in order to form low-melting metal element electrodes 7*a* and 7*b* on the substrate 2.

Low-melting metal foil (Sn:Sb=95:5; liquidus point: 240° C.; dimensions: 1 mm×4 mm) was subsequently thermocompression-bonded over the low-melting metal element electrode 7*a,* good conductor layer 11*a,* and low-melting metal element electrode 7*b* in order to form a low-melting metal element 5.

A liquid-crystal polymer cap was mounted on the side of the low-melting metal element 5, yielding a protective device 1H.

COMPARATIVE EXAMPLE 1

Figure 12A:
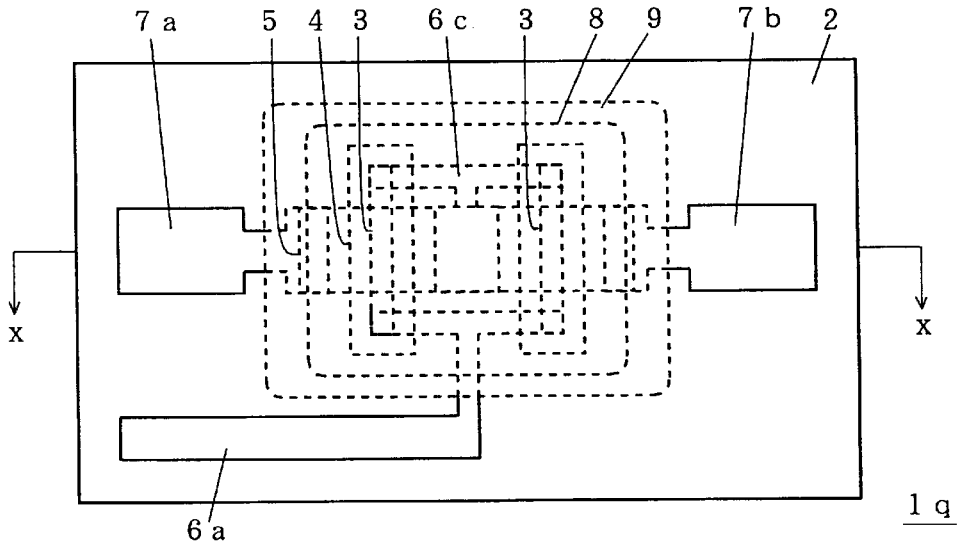
FIG. 12A and FIG. 12B are respectively a plane view and a cross sectional view of a conventional protective device.
Figure 12B:
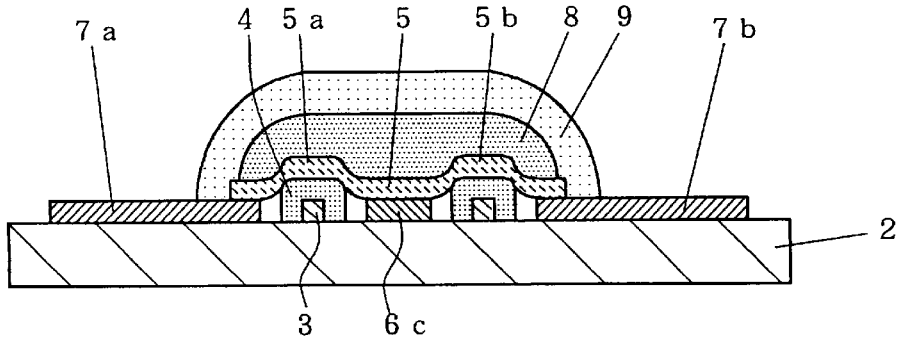
Figure 13:
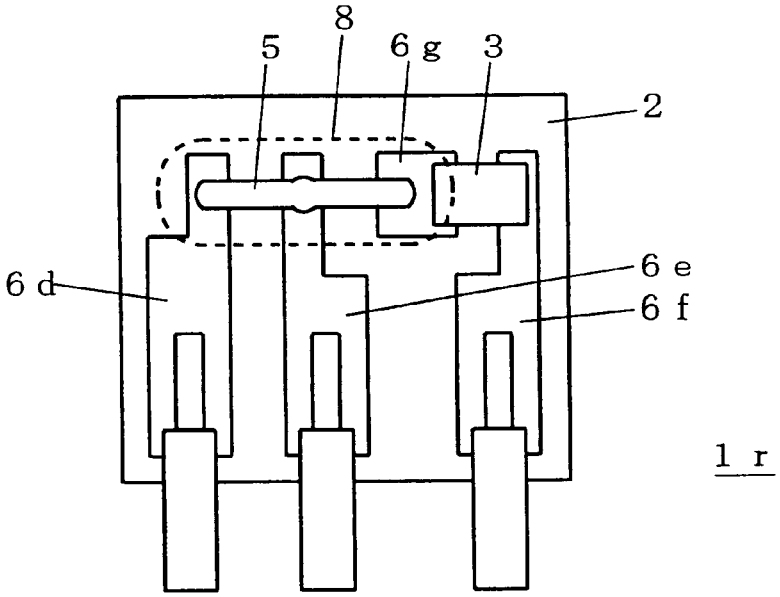
FIG. 13 is a plane view of a conventional protective device.

The protective device 1*q* shown in FIGS. 12A and 12B was fabricated in the following manner. An alumina ceramic substrate (thickness: 0.5 mm; dimensions: 5 mm×3 mm) was prepared as a substrate 2, and an Ag paste (QS174, manufactured by Du Pont) was printed and baked for 30 minutes at 870° C. in order to form low-melting metal element electrodes 7*a* and 7*b,* a heating element electrode 6*a,* and an intermediate electrode 6*c.* A ruthenium oxide-based resistance paste (DP1900, manufactured by Du Pont) was subsequently printed and baked for 30 minutes at 870° C. in order to form a pair of heating elements 3. The resistance value of each of the heating elements 3 (thickness: 10 μm; dimensions: 0.1 mm×2.0 mm) was 4 Ω. A silica-based insulating paste (AP5346, manufactured by Du Pont) was printed on each of the heating elements 3 and baked for 30 minutes at 500° C., yielding an insulating layer 4. Low-melting metal foil (Sn:Sb=95:5; liquidus point: 240° C.; dimensions: 1 mm×4 mm) was subsequently thermocompression-bonded as a low-melting metal element 5.

A liquid-crystal polymer cap was mounted on the side of the low-melting metal element 5, yielding a protective device 1*q*.

WORKING EXAMPLE 2

The dimensions of the low-melting metal foil were reduced to 1 mm×2 mm, and the dimensions of the entire protective device (that is, the dimensions of the substrate 2) were reduced to 3.5 mm×2.5 mm while the rated current value (cross sectional area of the low-melting metal foil) was kept at the same level as in Working Example 1, and the same structure as in Working Example 1 was used.

COMPARATIVE EXAMPLE 2

In the same structure as that used in Comparative Example 1, the dimensions of the low-melting metal foil were merely reduced to 1 mm×2 mm, and the dimensions of the entire protective device were reduced to 3.5 mm×2.5 mm.

Evaluation

Voltage was applied such that power consumption in the heating element 3 in each of the working and comparative examples was 4 W, and the time elapsed until the low-melting metal element 5 had fused was measured.

As a result, the protective device of Comparative Example 1 needed 21 seconds to fuse, whereas the time for the protective device of Working Example 1 was 15 seconds. In addition, the protective device of Working Example 2 was smaller than the protective device of Working Example 1, so both the heat capacity and the radiation capacity were lower than those of the protective device of Working Example 1, and the fusion time was reduced to 10 seconds. By contrast, the protective device of Comparative Example 2 failed to provide the surface area needed for the hot-melted low-melting metal element 5 to wet the intermediate electrode 6*c* or the low-melting metal element electrode 7*a* or 7*b* after the low-melting metal element 5 has been melted, making it impossible to fuse the low-melting metal element 5 even after voltage had been applied for 120 seconds.

The present invention provides a protective device in which electric current is passed through a heating element, the heating element is heated, and a low-melting metal element is fused by generated heat, wherein the heating element and the low-melting metal element are arranged in three dimensions so as not to allow an insulating layer to intervene therebetween. It is therefore possible to reduce the operating time. It is also possible to miniaturize the protective device without reducing the rated current.

The entire disclosure of the specification, claims, summary and drawings of Japanese Patent application No. 11-94385 filed on Mar. 31, 1999 is herein incorporated by reference.

What we claim is:

1. A protective device, comprising a heating element and a low-melting metal element on a substrate, the low-melting metal element being fused by the heat generated by the heating element, wherein the heating element and the low-melting metal element are stacked so as not to allow an insulating layer to intervene therebetween;

wherein electrodes are formed at both ends of the low-melting metal element, and the heating element is disposed between these electrodes at a position in which the heating element does not come into contact with the electrodes; and wherein a metal layer readily wettable by the low-melting metal element during heat melting is formed on the heating element, and the low-melting metal element is stacked on said metal layer.

2. A protective device as defined in claim 1 wherein a first good conductor layer whose electrical conductivity is higher than those of the heating element and of the low-melting metal element is formed on the heating element, and the low-melting metal element is stacked on said first good conductor layer.

3. A protective device according to claim 1, wherein a second good conductor layer whose electrical conductivity is higher than those of the heating element and of the low-melting metal element is formed on the substrate, and the heating element is formed on said second good conductor layer.

4. A protective device according to claim 3, wherein the second good conductor layer is covered with the heating element.

5. A protective device according to claim 4, wherein an intermediate electrode is brought out from inside the second good conductor layer, and the resistance value of the intermediate electrode is lower than that of the heating element and higher than that of the good conductor layers.

* * * * *